US007240855B2

(12) United States Patent
Takagi et al.

(10) Patent No.: US 7,240,855 B2
(45) Date of Patent: Jul. 10, 2007

(54) LIQUID DISPENSE HEAD AND MANUFACTURING METHOD THEREOF

(75) Inventors: Fumio Takagi, Chino (JP); Ryuichi Kurosawa, Okaya (JP); Daisuke Sawaki, Suwa (JP)

(73) Assignee: Seiko Epson Corporation (JP)

( * ) Notice: Subject to any disclaimer, the term of this patent is extended or adjusted under 35 U.S.C. 154(b) by 275 days.

(21) Appl. No.: 10/827,617

(22) Filed: Apr. 19, 2004

(65) Prior Publication Data

US 2005/0001050 A1 Jan. 6, 2005

(30) Foreign Application Priority Data

May 15, 2003 (JP) ..... 2003-136808

(51) Int. Cl.
*B05B 1/08* (2006.01)

(52) U.S. Cl. ..... 239/102.2; 239/102.1; 239/552; 239/566; 239/596; 347/47; 347/70; 347/85

(58) Field of Classification Search ..... 239/102.1, 239/102.2, 548, 552, 566, 589, 592, 594, 239/596; 347/47, 68, 70, 75, 85
See application file for complete search history.

(56) References Cited

U.S. PATENT DOCUMENTS 3,900,162 A * 8/1975 Titus et al. ..... 239/102.2
6,491,969 B2 * 12/2002 Eldridge ..... 347/47
6,502,921 B2 * 1/2003 Kanda et al. ..... 347/70
6,568,799 B1 * 5/2003 Yang et al. ..... 347/85
6,722,582 B2 * 4/2004 Hess et al. ..... 239/102.2
2003/0016270 A1 * 1/2003 Kubota et al. ..... 347/47

FOREIGN PATENT DOCUMENTS

| | | |
|---|---|---|
| JP | 2001-001548 | 1/2001 |
| JP | 2001-270114 | 10/2001 |
| JP | 2002-286735 | 10/2002 |
| JP | 2003-231251 | 8/2003 |

* cited by examiner

*Primary Examiner*—Steven J. Ganey
(74) *Attorney, Agent, or Firm*—Harness, Dickey & Pierce, P.L.C.

(57) ABSTRACT

A liquid dispense head is provided which can be manufactured at a reduced manufacturing cost, will not react with dispense liquid containing biomolecules, and can dispense liquid droplets having a constant amount from individual nozzles. The liquid dispense head has reservoirs used as reservoirs for containing liquid, pressure chambers for applying a pressure to dispense the liquid, flow passages connecting the pressure chambers and the respective reservoirs. In the liquid dispense head described above, a part of the flow passage is formed of a minute through-hole provided in a glass substrate, and the inside diameter of the minute through-hole is continuously decreased or increased.

3 Claims, 4 Drawing Sheets

LIQUID DISPENSE HEAD AND MANUFACTURING METHOD THEREOF

RELATED APPLICATIONS

This application claims priority to Japanese Patent Application No. 2003-136808 filed May 15, 2003 which is hereby expressly incorporated by reference herein in its entirety.

BACKGROUND OF THE INVENTION

1. Field of the Invention

The present invention relates to liquid dispense heads and manufacturing methods thereof, the liquid dispense heads being used, for example, for fabricating a microarray by dispensing a solution containing biomolecules such as proteins or nucleic acids onto a solid member.

2. Description of the Related Art

Heretofore, when various types of probe samples are to be dispensed on a microarray substrate, a contact-pin method or an ink-jet method has been widely used.

According to an ink-jet method, by decreasing pitches between nozzles, a high density microarray can be fabricated.

In addition, in a conventional liquid dispense device, in order to supply liquid from reservoirs independent from each other to respective nozzles, there have been disclosed a method for forming by a photolithographic technique a liquid feed plate integrated with a heater board functioning as a dispense energy generator, and a method for forming the aforementioned liquid feed plate by laminating a great number of alumina plates to each other.

In the aforementioned conventional liquid dispense device, since a great number of independent reservoirs and/or liquid flow passages communicating therewith are formed in a liquid feed plate by a photolithographic technique, the capacity and the number of the reservoirs have been disadvantageously limited.

In addition, since the heater board functioning as a dispense energy generator and the liquid feed plate are formed from a silicon substrate, and the flow passages penetrating in the thickness direction are formed using anisotropic etching, there has been a problem in that the nozzles can not be formed with a high density.

In addition, when the liquid feed plate is formed by laminating a great number of alumina plates to each other, a great number of plates having holes and grooves are laminated to each other. Then, tasks of machining the plates and laminating them with an adhesive are required, resulting in increase in manufacturing cost. In addition, there has been concern about the probability of reaction between the above adhesive and a dispense solution, that is, a solution containing biological polymer materials.

SUMMARY OF THE INVENTION

The present invention was made in order to solve the problems described above, causing reduction of manufacturing cost and probability of reaction with a dispense solution containing biological polymer materials. Further, and object of the present invention is to provide a liquid dispense head capable of dispensing many types of liquid from nozzles arranged with a high density, regardless of the capacity and the number of the reservoirs, and a manufacturing method thereof.

(1) A liquid dispense head according to one aspect of the present invention, comprises: a reservoir for containing liquid; a pressure chamber for applying a pressure to dispense the liquid; a flow passage connecting the reservoir and the pressure chamber; and a nozzle hole for dispensing a liquid droplet from the pressure chamber, wherein a part of the flow passage is formed of a minute through-hole provided in a glass substrate, and the inside diameter of the minute through-hole is continuously decreased or increased.

According to the structure described above, the arrangement and the number of reservoirs can be freely determined, and in addition, the nozzles can be arranged with a high density. Furthermore, since the inside diameter of the through-hole is continuously changed, bubbles are hardly trapped. In addition, since the flow passage resistance is low due to a smooth surface of the through-hole and the variation in inside diameter is small, droplets having a constant amount can be dispensed.

(2) In the liquid dispense head of the present invention, since the inside diameter at a narrow part of the minute through-hole is smaller than the inside diameter of the nozzle hole, a filter effect of preventing nozzle clogging at the narrow part of the minute through-hole may be expected.

(3) In the liquid dispense head of the present invention, when the narrow part of the minute through-hole is located on the side near the reservoir, the inside diameter of the minute through-hole is increased toward the pressure chamber, and a rapid pressure difference is generated. As a result, due to a diffuser effect, the supply of the liquid into the pressure chamber becomes easier, thereby improving dispense efficiency.

(4) In the liquid dispense head of the present invention, when the narrow part of the minute through-hole is located on the side near the pressure chamber, the inside diameter of the minute through-hole is decreased toward the pressure chamber, and as a result, the liquid can be supplied into small pressure chambers arranged with a high density.

(5) The liquid dispense head of the present invention may further comprise an electrostatic actuator on the glass substrate, which is formed of an electrode and a minute gap, so that when the liquid is a solution containing biomolecules, the transformation thereof caused by the generation of heat may not occur unlike the case of a thermal ink-jet method.

(6) In the liquid dispense head of the present invention, when the glass substrate is bonded to a pressure chamber substrate provided with the pressure chamber so as to seal a piezoelectric actuator provided on the pressure chamber substrate, and the liquid is a solution containing a biomolecules, the transformation thereof caused by the generation of heat may not occur unlike the case of a thermal ink-jet method.

(7) In the liquid dispense head of the present invention, when the glass substrate is a borosilicate glass substrate and the pressure chamber substrate provided with the pressure chamber is a silicon substrate, the glass substrate and the pressure chamber substrate can be bonded to each other by an anode bonding method. As a result, it is not necessary to use an adhesive which may react with the dispense liquid in some cases.

(8) In a method, in accordance with another aspect of the present invention, for manufacturing a liquid dispense head which comprises a reservoir for containing liquid, a pressure chamber for applying a pressure to dispense the liquid, a flow passage connecting the reservoir and the pressure chamber, and a nozzle hole for dispensing a liquid droplet from the pressure chamber, a part of the flow passage being formed of a minute through-hole provided in a glass substrate, the method comprises irradiating the glass substrate with laser beams and then performing wet etching of the glass substrate to form a minute through-hole having an inside diameter which is continuously increased or decreased.

As described above, by using laser radiation and wet etching, without using a photolithographic technique, a minute through-hole having an inside diameter which is continuously increased or decreased can be formed in the glass substrate, and hence bubbles are hardly trapped due to the continuous change in inside diameter of the minute through-hole thus formed. In addition, since the flow passage resistance is decreased due to a smooth surface of the minute through-hole and the variation in inside diameter is small, liquid droplets having a constant amount can be dispensed.

(9) In a method for manufacturing a liquid dispense head which comprises a reservoir for containing liquid, a pressure chamber for applying a pressure for dispensing the liquid, a flow passage connecting the reservoir and the pressure chamber, and a nozzle hole for dispensing a liquid droplet from the pressure chamber, a part of the flow passage being formed of a minute through-hole provided in a glass substrate, a method in accordance with another aspect of the present invention comprises preparing a photosensitive glass as the glass substrate; irradiating the glass substrate with laser beams, followed by heat treatment; and subsequently performing wet etching of the glass substrate to form a minute through-hole having an inside diameter which is continuously increased or decreased.

As described above, since the photosensitive glass is irradiated with laser beams and is processed by wet etching, without using a photolithographic technique, a minute through-hole having an inside diameter continuously increased or decreased can be formed in the glass substrate, and hence bubbles are hardly trapped due to the continuous change in inside diameter of the minute through-hole thus formed.

In addition, since the photosensitive glass is used as the glass substrate, an etching rate of a part thereof irradiated with laser beams is increased, and as a result, the etching time can be decreased.

(10) In the method for manufacturing a liquid dispense head, according to the above (8) or (9), femto-second laser beams are preferably used as the laser beams. Since a minute region can be processed by applying a high energy thereto, a minute through-hole having a fine structure can be formed with high accuracy by the following etching treatment.

(11) In the method for manufacturing a liquid dispense head, according to the above (8), it is preferable that the glass substrate is made of borosilicate glass, the pressure chamber is formed in a pressure chamber substrate made of silicon, and the glass substrate and the pressure chamber substrate are bonded to each other by an anode bonding method.

As described above, since the pressure chamber substrate is bonded by an anode bonding method to the glass substrate provided with minute through-holes formed by laser radiation and wet etching, it is not necessary to use an adhesive which may react with the dispense solution in some cases.

DESCRIPTION OF THE PREFERRED EMBODIMENTS

First Embodiment

Figure 1:
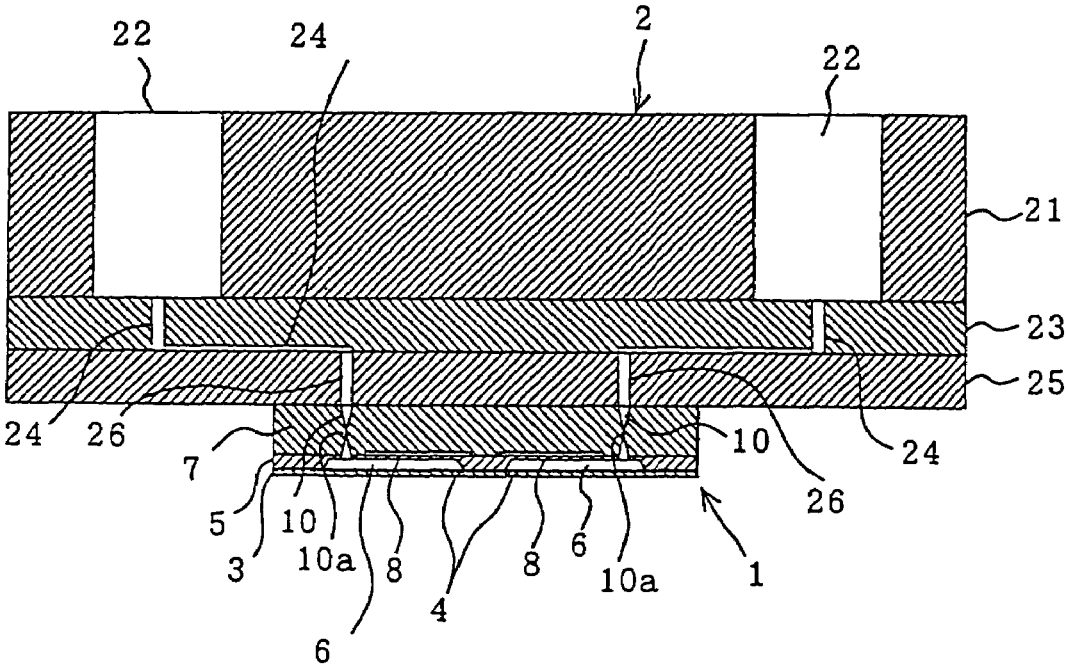
FIG. 1 is a cross-sectional view showing the structure of a liquid dispense head according to a first embodiment of the present invention.
Figure 2:
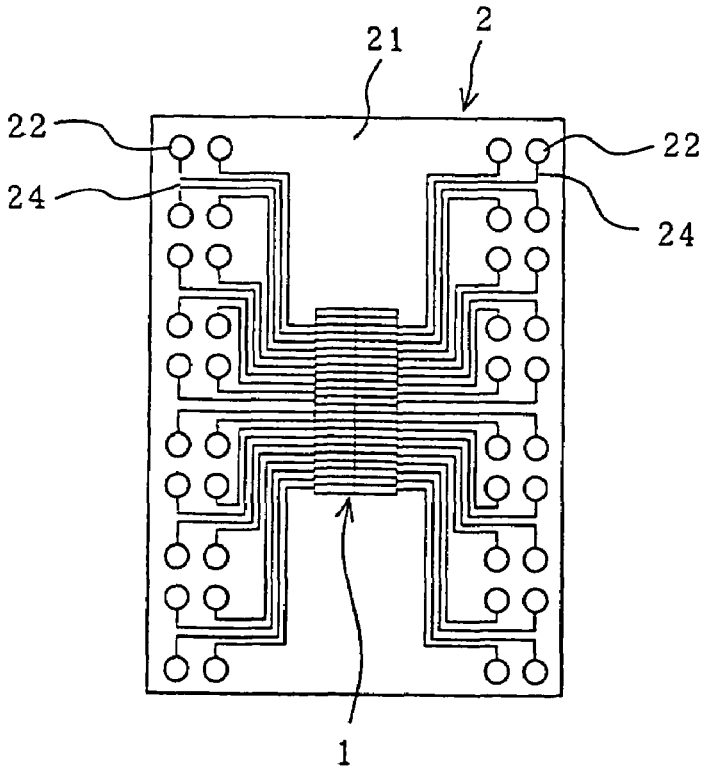
FIG. 2 is a structural view of the liquid dispense head when it is viewed from above.
Figure 3:
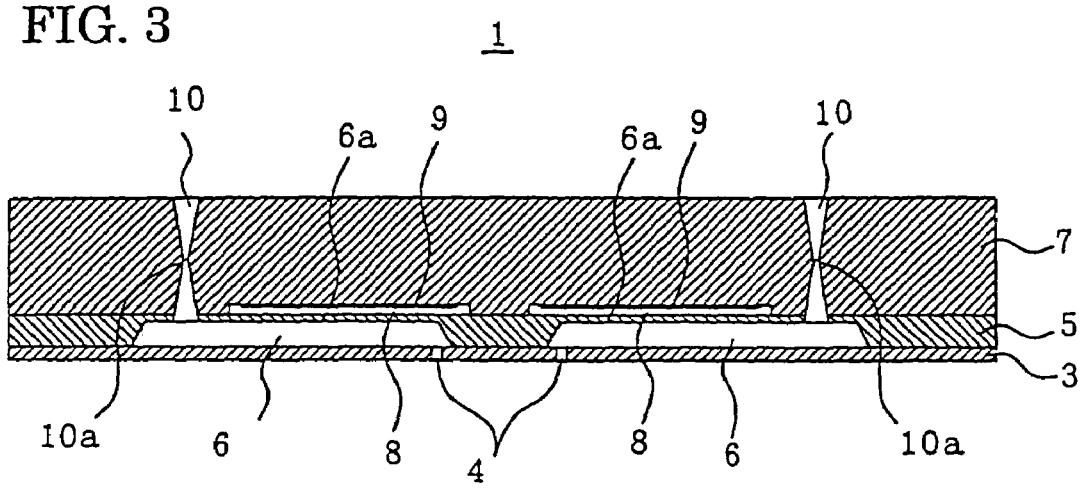
FIG. 3 is a cross-sectional view showing the structure of a head chip of the liquid dispense head.
Figure 4:
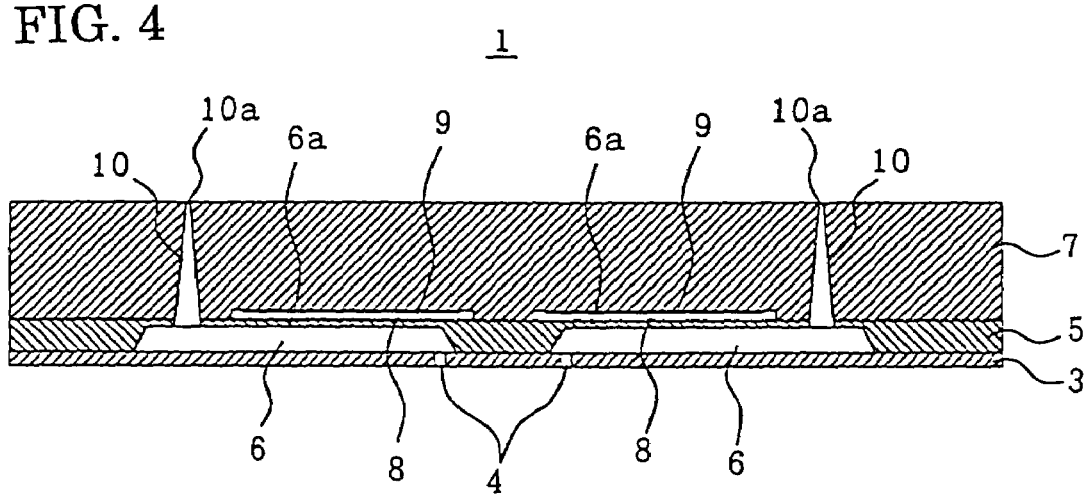
FIG. 4 is a cross-sectional view showing the structure of the head chip according to a first modified example.
Figure 5:
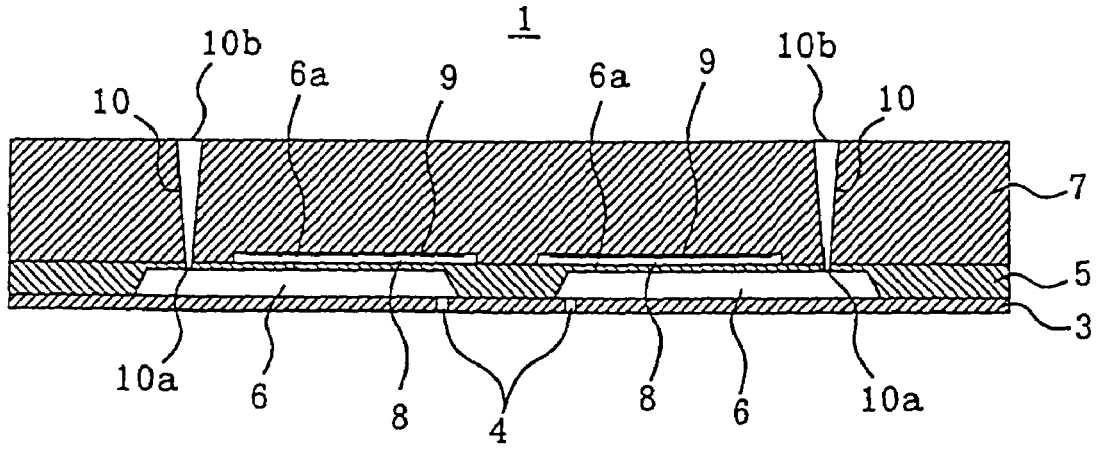
FIG. 5 is a cross-sectional view showing the structure of the head chip according to a second modified example.
Figure 6:
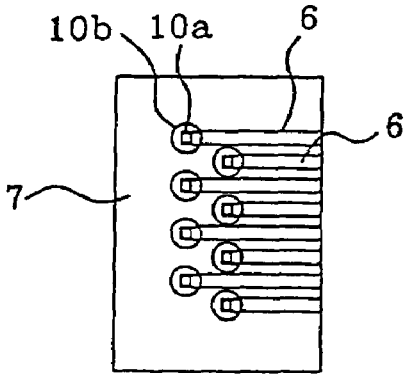
FIG. 6 is a cross-sectional view showing the structure of the head chip according to the second modified example.
Figure 7:
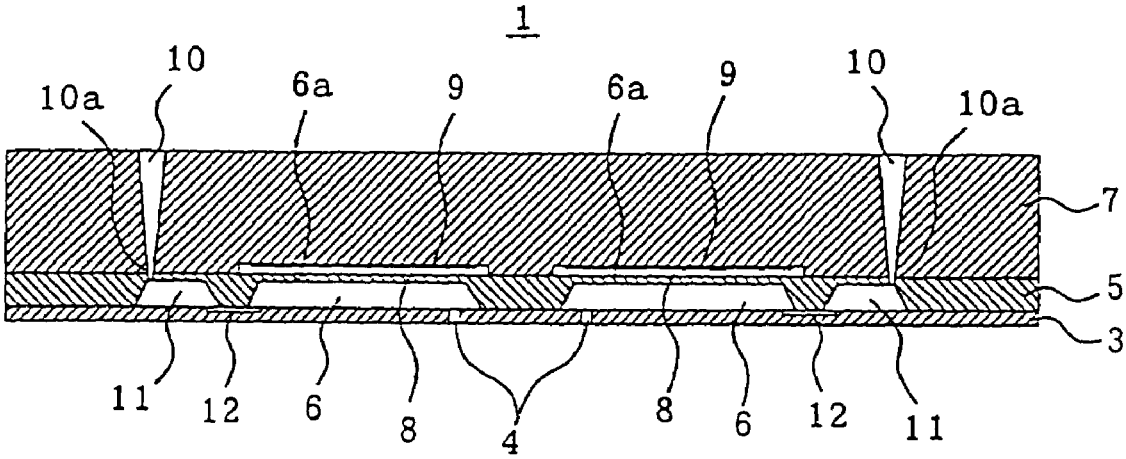
FIG. 7 is a cross-sectional view showing the structure of the head chip according to a third modified example.

FIG. 1 is a cross-sectional view showing the structure of a liquid dispense head according to a first embodiment of the present invention; FIG. 2 is a structural view showing the liquid dispense head viewed from above: FIG. 3 is a cross-sectional view showing the structure of a head chip of the liquid dispense head; FIG. 4 is a cross-sectional view showing the structure of the head chip according to a first modified example; FIG. 5 is a cross-sectional view showing the structure of the head chip according to a second modified example; FIG. 6 is a structural view of the head chip according to the second modified example when it is viewed from above; and FIG. 7 is a cross-sectional view showing the structure of the head chip according to a third modified example.

In the figures, the liquid dispense head consists of a dispense head chip 1 for dispensing many types of liquid droplets, for example, solutions containing biomolecules, and a reservoir unit 2 for supplying the many types of liquid to the dispense head chip 1.

This dispense head chip 1 comprises a thin first silicon substrate 3 having a plurality of nozzle holes 4 therein formed by etching, a second silicon substrate 5 having grooves therein formed by etching, which are to be formed into pressure chambers 6 for dispensing liquid droplets from the individual nozzle holes 4, and a glass substrate 7 having concave portions 8 each forming an electrostatic actuator and minute through-holes 10 each functioning as a flow passage.

The first silicon substrate 3, the second silicon substrate 5, and the glass substrate 7 are integrally assembled together to form the dispense head chip 1 in which the grooves of the second silicon substrate 5 serve as the pressure chambers 6, and the nozzle holes 4 of the first silicon substrate 3 communicate with the respective pressure chambers 6.

In addition, the reservoir unit 2 comprises a reservoir plate 21, a first microchannel plate 23, and a second microchannel plate 25. The reservoir plate 21 is made of polymethyl methacrylate (PMMA) and has reservoirs 22 each functioning as a reservoir for containing liquid. The first and the second microchannel plates 23 and 25 have flow passages which communicate with the respective reservoirs 22 and supply the liquid therefrom to the pressure chambers 6. First microchannels 24 and second microchannels 26 are formed in the first microchannel plate 23 and the second microchannel plate 25, respectively.

The reservoir plate 21, the first microchannel plate 23, and the second microchannel plate 25 are integrally assembled together, thereby forming the reservoir unit 2.

The pressure chamber 6 of the dispense head chip 1 serves to store liquid to be dispensed from the nozzle hole 4. The pressure chamber is formed so as to have at least one wall thereof (in this embodiment, a bottom wall hereinafter referred to as a "vibration plate 6*a*") which can be wrapped to change its shape, and electrodes 9 provided at parts of the respective concave portions 8 of the glass substrate 7. The electrode 9, the vibration plate 6a and a minute gap formed between the electrode 9 and the vibration plate 6*a* form an electrostatic actuator.

That is, when the electrode 9 is positively charged by a charge supplied thereto and the vibration plate 6*a* is negatively charged, the vibration plate 6*a* is drawn toward the electrode 9, and as a result, the volume of the pressure chamber 6 is increased. When the supply of the charge to the electrode 9 is stopped, the vibration plate 6*a* returns to the original position thereof, and upon this return, the volume of the pressure chamber 6 is decreased to the original volume thereof; hence, a liquid droplet is dispensed by the pressure thus generated. Accordingly, the distance (minute gap) between the vibration plate 6*a* and the electrode 9 has influence on the dispense amount of the liquid droplet.

In this first embodiment, since the electrode 9, i.e., a part of the electrostatic actuator, is provided at a part of the concave portion 8 formed in the glass substrate 7, the glass substrate 7 functions as an electrode glass of the electrostatic actuator.

In addition, as shown in FIG. 1, the minute through-hole 10, which is formed in the glass substrate 7 of the dispense head chip 1 by laser processing and wet etching, has an inside diameter that is continuously decreased toward the center of the plate thickness and has a narrow portion 10*a* having a higher flow resistance than that of each of the first microchannel 24 and the second microchannel 26. The inside diameter of the narrow portion 10*a* is formed smaller than that of the nozzle hole 4.

As described above, the narrow portion 10*a* of the minute through-hole 10 has a high flow resistance than that of each of the first and the second microchannels 24 and 26, the variation in flow resistance between the first and the second microchannels 24 and 26 caused by the difference in length therebetween can be cancelled, and as a result, liquid droplets having a constant amount can be dispensed from all the nozzle holes 4.

In addition, since the minute through-hole 10 is formed by laser processing and wet etching, the hole has a smoother surface with a lower flow resistance, and the variation in diameter of the hole is small compared to a hole formed only by common laser processing; so that the variation in dispense amount is small.

In addition, since the diameter of the narrow portion 10*a* of the minute through-hole 10 formed in the glass substrate 7 of the dispense head chip 1 is smaller than the inside diameter of the nozzle hole 4, it is expected that the narrow portion 10*a* of the minute through-hole 10 have a filter effect of preventing nozzle clogging.

Furthermore, due to the continuous change in inside diameter of the minute through-hole 10, bubbles are hardly trapped and hence are easily eliminated when the liquid is filled.

In addition, as shown in FIG. 4, the narrow portion 10*a* of the minute through-hole 10 is located on the side near the reservoir 22, and the inside diameter of the minute through-hole 10 is continuously increased toward the pressure chamber 6.

When the minute through-hole 10 provided in the glass substrate 7 is formed so that the inside diameter is continuously increased toward the pressure chamber 6 as described above, a rapid pressure difference is generated thereby, and as a result, the dispense efficiency is improved due to the diffuser effect.

Furthermore, as shown in FIG. 5, the narrow portion 10*a* of the minute through-hole 10 is located on the side near the pressure chamber 6, and the inside diameter of the minute through-hole 10 is continuously decreased toward the pressure chamber 6.

When the minute through-hole 10 provided in the glass substrate 7 is formed so that the inside diameter is continuously decreased toward the pressure chamber 6 as described above, the liquid can be supplied to small pressure chambers 6 arranged with a high density.

That is, when the minute through-hole 10 provided in the glass substrate 7 is formed so that the inside diameter is continuously decreased toward the pressure chamber 6, the narrow portion 10*a* of the minute through-hole 10 forms a hole on the bottom surface, and a wide portion 10*b* of the minute through-hole 10, which has the maximum inside diameter, forms a hole on the upper surface. Accordingly, when disposed in a zigzag manner as shown in FIG. 6, the pressure chambers 6 can be arranged with a high density.

In addition, as shown in FIG. 7, the structure may be formed in which small pools 11 for retaining liquid, each provided between the minute through-hole 10 and the pressure chamber 6, are formed so as to communicate with the respective pressure chambers 6 through orifices 12 therebetween.

The flow passage resistance of this orifice 12 is set to be larger than that of the narrow portion 10*a* of the minute through-hole 10, so that the flow passage resistance of liquid to the pressure chamber 6 can be controlled.

Next, one example of a method for manufacturing the aforementioned dispense head will be described.

First, a method for manufacturing the dispense head chip 1 of the dispense head will be described.

The nozzle hole 4 of the first silicon substrate 3 is formed by the following method. A silicon substrate is first mirror-polished, and a $SiO_2$ film is formed on the surface thereof. On this film thus formed, a photoresist pattern is further formed, and etching is then performed using a hydrofluoric acid-base etchant. By this etching, the exposed $SiO_2$ film is removed, and the photoresist pattern is then removed. Subsequently, isotropic etching of the silicon substrate using an alkali solution, such as an aqueous potassium hydroxide (KOH) solution or hydrazine, and anisotropic dry etching are carried out.

The pressure chamber 6 of the second silicon substrate 5 is formed in the same manner as that for the nozzle hole 4 of the first silicon substrate 3.

The concave portions 8 of the glass substrate 7 are formed by the steps of forming a film on the surface of the glass substrate by sputtering chromium and gold, forming a pattern for providing the concave portions 8, each of which is to be used as an actuator, on the film mentioned above, and then performing etching using a hydrofluoric acid-base etchant. Subsequently, an ITO film is formed by sputtering, followed by patterning thereof, thereby forming electrodes.

As described above, the minute through-hole 10 of the glass substrate 7 is formed by laser processing and wet etching. With reference to FIGS. 8A to 8E which show manufacturing steps of the minute through-hole 10, a detailed manufacturing process of the minute through-hole 10 will be described.

Figure 8:
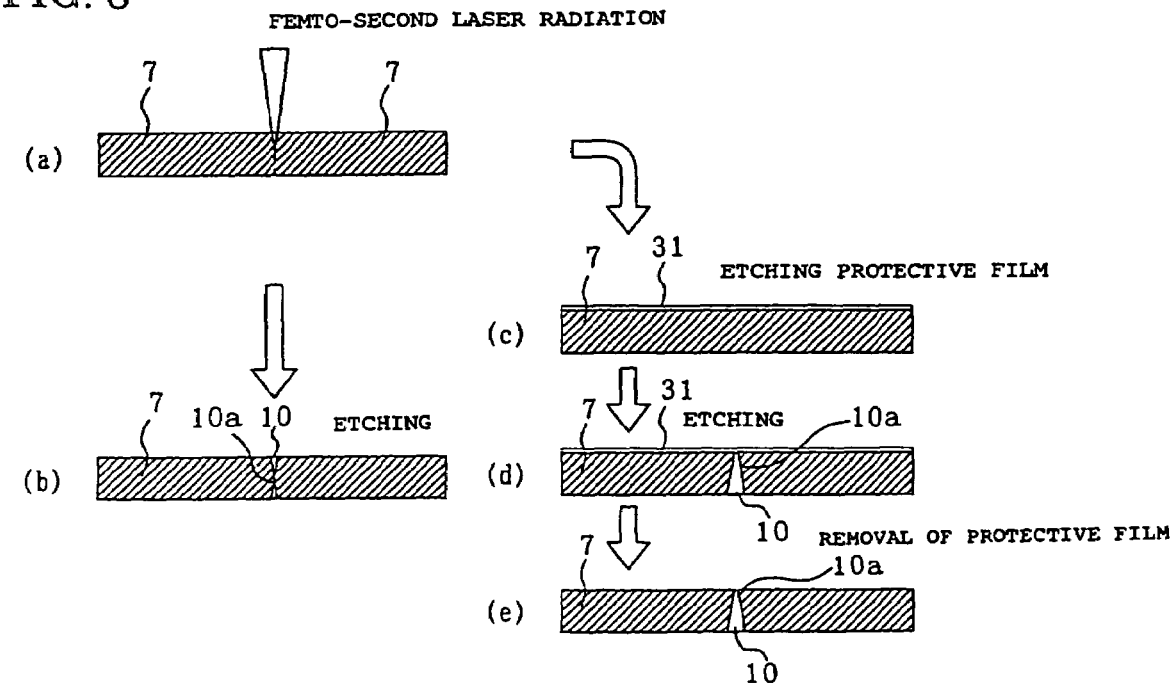
FIGS. 8A to 8E are schematic views each showing a step of a manufacturing process of a minute through-hole of the head chip.

First, as shown in FIG. 8A, a minute region of the glass substrate 7 where the minute through-hole 10 is to be formed is irradiated with femto-second laser beams to form a transformation phase in the minute region. In this step, by moving a focus position (that is, a position on which the laser beams are focused is shifted), a local transformation region can be freely formed at any place on the surface of a glass and in the thickness direction thereof.

Subsequently, as shown in FIG. 8B, after the glass substrate 7 is immersed in a hydrofluoric acid solution at a concentration of 20%, the transformation phase is selectively etched. A hole having a conical shape is formed from the surface of the substrate by etching, and this shape is grown with time.

As shown in FIG. 8B, in particular, when an etching mask is not provided, etching is performed from both sides of the substrate, and as a result, as shown in FIGS. 1 and 3, the minute through-hole 10 is formed having the narrow portion 10*a* at the central portion in the thickness direction.

In addition, for forming the minute through-hole 10 having an inside diameter which is continuously increased toward the pressure chamber 6 as shown in FIG. 4 or the minute through-hole 10 having an inside diameter which is continuously decreased toward the pressure chamber 6 as shown in FIG. 5, after a transformation phase is formed in a minute region of the glass substrate 7 using femto-second laser beams as shown in FIG. 8C, an etching protective film 31 is formed on one surface of the glass substrate 7 by sputtering chromium and gold, and as shown in FIG. 8D, etching is then performed by immersing the substrate into a hydrofluoric acid solution at a concentration of 20%, thereby forming the minute through-hole 10 having the narrow portion 10*a* located on the side of the surface which is protected. Subsequently, as shown in FIG. 8E, the etching protective film 31 is removed, and hence the minute through-hole 10 is formed in the glass substrate 7.

In order to form the minute through-hole 10 described above in the glass substrate 7, the radiation conditions of femto-second laser beams are set as follows:

Laser wavelength: 800 nm

Laser Pulse Width: 100 fs

Reception frequency: 1 kHz

Laser Power: 1 to 500 mW (preferably 1 to 10 mW)

Laser Scan Rate 0.1 to 1 mm/sec

The femto-second laser beams have a pulse width of less than one picosecond; however, it is naturally understood that beams having a pulse width larger than that mentioned above is also able to form a transformation phase in a minute region of a glass substrate.

The second silicon substrate 5 which forms the pressure chambers 6 and the glass substrate 7 in which the concave portions 8 and the minute through-holes 10 are formed are bonded to each other by an anode bonding method. In the anode bonding method, for example, a DC voltage of 500 V is applied for 5 minutes between the substrates laminated to each other while they are heated to 300° C., in which the first and the second silicon substrates 3 and 5 are used as an anode and the glass substrate 7 is used as a cathode. According to this method, since bonding can be performed without using any adhesives, the durability of the bonding is superior.

Only when being formed of a borosilicate glass, that is, a so-called heat resistance glass, the glass substrate 7 can be bonded to the silicon substrate 5 by an anode boding method.

In addition, since this anode bonding method uses no adhesives, the probability of reaction between adhesives and the dispense liquid can be reduced.

Next, a method for manufacturing the reservoir unit 2 of the dispense head will be described.

The reservoir plate 21 having reservoirs 22, the first microchannel plate 23 having the first microchannels 24, and the second microchannel plate 25 having the second microchannels 26 are integrally assembled together to form the reserever unit 2.

These plates 21, 23, and 25 are formed of polymethyl methacrylate (PMMA), and as a method for forming the reservoirs and the microchannels, injection molding, hot embossing, laser processing, or machining may be used. The bonding therebetween is performed by thermo-compression bonding.

In addition, the dispense head chip 1 and the reservoir unit 2 thus formed are bonded to each other with an adhesive, thereby forming the liquid dispense head.

According to the first embodiment described above, the flow passage resistance of the narrow portion 10*a* of the minute through-hole 10, which is a part of the flow passage communicating between the pressure chamber 6 of the dispense head chip 1 and the reservoir 22 of the reservoir unit 2, is higher than that of each of the first and the second microchannels 24 and 26. Therefore, the variation in flow passage resistance between the first and the second microchannels 24 and 26 caused by the difference in length therebetween can be cancelled, and as a result, liquid droplets having a constant amount can be supplied from all the nozzle holes 4.

Accordingly, an orifice for flow passage resistance adjustment is not necessary for the first silicon substrate 3 or the second silicon substrate 5.

In addition, since the inside diameter of the minute through-hole 10, which is a part of the flow passage connecting the pressure chamber 6 of the dispense head chip 1 and the reservoir 22 of the reservoir unit 2, is continuously decreased or increased, due to continuous change in inside diameter, bubbles are hardly trapped. In addition, since the flow passage resistance is decreased due to the smooth surface, and the variation in hole diameter is small, the variation in dispense amount is decreased, and hence liquid droplets having a constant amount can be dispensed.

Furthermore, since the narrow portion 10*a* of the minute through-hole 10 formed in the dispense head chip 1 has an inside diameter smaller than that of the nozzle hole 4, the filer effect can be expected which prevents nozzle clogging.

In addition, when the narrow portion 10*a* of the minute through-hole 10 formed in the dispense head chip 1 is located on the side near the reservoir 22, and the inside diameter of the minute through-hole 10 is increased toward the pressure chamber 6, a rapid pressure difference is generated thereby, and as a result, the dispense efficiency is improved by the diffuser effect.

When the narrow portion 10*a* of the minute through-hole 10 formed in the dispense head chip 1 is located on the side near the pressure chamber 6, and the inside diameter of the minute through-hole 10 is decreased toward the pressure chamber 6, the liquid can be supplied to small pressure chambers 6 which are arranged with a high density.

In addition, when the electrostatic actuator composed of the minute gap and the electrode 9 is formed on the glass substrate 7 of the dispense head chip 1, and the liquid is a solution containing biomolecules, unlike a thermal ink-jet method, the transformation of biomolecules caused by generation of heat will not occur.

Second Embodiment

Figure 9:
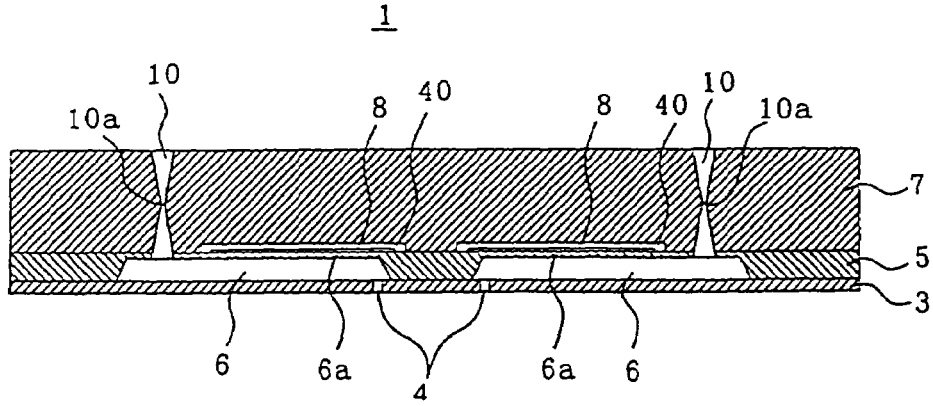
FIG. 9 is a cross-sectional view showing the structure of a liquid dispense head according to a second embodiment of the present invention.

FIG. 9 is a cross-sectional view showing the structure of a liquid dispense head according to a second embodiment of the present invention.

In this second embodiment, a piezoelectric actuator is used instead of the electrostatic actuator described in the first embodiment, in order to dispense liquid droplets from the nozzle holes 4 with a pressure increased by warping the vibration plate 6*a* which is the bottom wall of the pressure chamber 6 provided in the second silicon substrate 5 of the dispense head chip 1.

The rest of the structure is the same as that in the first embodiment, and the same reference numerals designate the same constituent elements. Descriptions of the same structure, effect, and advantages are omitted.

In this second embodiment, a piezoelectric thin film 40 is formed on the surface of the bottom wall of the pressure chamber 6 of the second silicon substrate 5. This piezoelectric thin film 40 and the vibration plate 6*a,* that is, the bottom wall of the pressure chamber 6, form the piezoelectric actuator.

When a voltage is applied to the piezoelectric thin film 40, due to a strain generated in the piezoelectric thin film 40, the vibration plate is warped, and the volume of the pressure chamber 6 is increased. When the application of a voltage is stopped, the strain in the piezoelectric thin film 40 disappears, and as a result, the volume of the pressure chamber 6 returns to the original one, thereby dispensing a liquid droplet.

In this second embodiment, since the concave portion 8 formed in the glass substrate 7 covers the piezoelectric thin film 40 so as to protect it, the piezoelectric thin film 40 being a part of the piezoelectric actuator formed on the surface of the bottom wall of the pressure chamber 6 provided in the second silicon substrate 5, the glass substrate 7 functions as a piezoelectric actuator protector.

In addition, in this second embodiment, the minute through-hole 10 formed in the glass substrate 7 may also have various shapes.

Third Embodiment

In the above first and the second embodiments, in consideration of bonding between the second silicon substrate 5 and the glass substrate 7, which has the concave portions 8 and the minute through-holes 10 of the dispense head chip 1, by an anode bonding method, a borosilicate glass is used for the glass substrate 7. In this third embodiment, however, a photosensitive glass is used for the glass substrate 7, and the minute through-hole 10 is formed by irradiating the photosensitive glass with laser beams, followed by heat development and etching.

The photosensitive glass of this embodiment comprises a $SiO_2$—$Li_2O$—$Al_2O_3$-based glass as a primary component, a photosensitive metal (at least one of Au, Ag, and Cu), and a sensitizer ($CeO_2$).

When this photosensitive glass is irradiated with laser beams, metal ions located at the irradiated part are turned into metal atoms, and by heat treatment performed at approximately 500 degree Celsius, metal colloids are formed. Subsequently, crystal nuclei are formed from the colloids, and crystal primarily composed of a glass component is precipitated. Since this crystal is easily dissolved in hydrofluoric acid, selective etching can be performed.

The etching rate of the irradiated part can be optionally changed by controlling the intensity of laser beams, the radiation amount thereof, and the heating conditions.

In this third embodiment, after the radiation of femtosecond laser beams is performed under the same conditions as those in the first embodiment, heating at 500 degree Celsius for 60 minutes and that at 550 degree Celsius for 60 minutes are performed, and etching is then performed by immersion of the photosensitive glass in a hydrofluoric acid solution at a concentration of 10% for 120 minutes.

When the photosensitive glass is used as is the case of the third embodiment described above, the etching rate of the irradiated part with laser beams is increased, and hence the etching time can be advantageously decreased.

In the liquid dispense head of the present invention, described above, the dispense solution was described as a solution containing biomolecules. In this case, when solutions containing various biomolecules are used as the dispense liquid, and many types of solution in a small amount are dispensed, the liquid dispense head of the present invention can be effectively used for manufacturing, for example, DNA chips, protein chips, and the like. Particularly by the pressure chamber 6, provided with the vibration plate 6*a,* biomolecules which are liable to be transformed by heating can be easily and efficiently handled, since heating is not required.

In addition, when a printing ink solution is used as the dispense liquid, the liquid dispense head of the present invention can be used for a typical color ink-jet printer in which printing is performed on common paper media or the like.

Furthermore, when the dispense liquid is a solution for forming a color filter, the liquid dispense head of the present invention can be used for manufacturing color filters used in liquid crystal display devices.

In addition, when the dispense liquid is a solution containing a luminescent material, the liquid dispense head of the present invention can be used for forming electroluminescent elements and hence can be used for manufacturing display devices using the elements.

What is claimed is:

1. A liquid dispense head comprising:

a reservoir for containing liquid;

a pressure chamber for applying a pressure to dispense the liquid;

a flow passage connecting the reservoir and the pressure chamber; and a nozzle hole for discharging a liquid droplet from the pressure chamber;

wherein a part of the flow passage is formed of a minute through-hole provided in a glass substrate; and an inside diameter of the minute through-hole is continuously decreased to a minimum diameter at a center of a thickness of the glass substrate.

2. A liquid dispense head comprising:

a reservoir for containing liquid;

a pressure chamber for applying a pressure to dispense the liquid;

a flow passage connecting the reservoir and the pressure chamber;

a nozzle hole for discharging a liquid droplet from the pressure chamber; and an electrostatic actuator, having a minute gap and an electrode provided on a glass substrate;

wherein a part of the flow passage is formed of a minute through-hole provided in the glass substrate; and an inside diameter of the minute through-hole is continuously decreased or increased.

3. A liquid dispense head comprising:

a reservoir for containing liquid;

a pressure chamber for applying a pressure to dispense the liquid;

a flow passage connecting the reservoir and the pressure chamber; and a nozzle hole for discharging a liquid droplet from the pressure chamber;

wherein a part of the flow passage is formed of a minute through-hole provided in a glass substrate;

an inside diameter of the minute through-hole is continuously decreased or increased; and the glass substrate is bonded to a pressure chamber substrate provided with the pressure chamber so as to seal a piezoelectric actuator provided on the pressure chamber substrate.

* * * * *